US006325036B1

(12) United States Patent
Gracyalny et al.

(10) Patent No.: US 6,325,036 B1
(45) Date of Patent: Dec. 4, 2001

(54) STARTING AND STOPPING DEVICE FOR AN INTERNAL COMBUSTION ENGINE

(75) Inventors: Gary J. Gracyalny, Milwaukee; John Santi, West Allis; Stanley Filipak, Dousman; Elliot J. Matel, Milwaukee, all of WI (US)

(73) Assignee: Briggs & Stratton Corporation, Milwaukee, WI (US)

( * ) Notice: Subject to any disclaimer, the term of this patent is extended or adjusted under 35 U.S.C. 154(b) by 0 days.

(21) Appl. No.: 09/644,624

(22) Filed: Aug. 23, 2000

Related U.S. Application Data

(63) Continuation-in-part of application No. 09/183,425, filed on Oct. 30, 1998, now Pat. No. 6,230,678.

(51) Int. Cl.[7] ..... F02N 5/02

(52) U.S. Cl. ..... 123/185.14; 123/185.8; 185/41 A; 74/7 C

(58) Field of Search ..... 123/185.14, 185.8; 185/41 A; 74/7 R, 7 C

(56) References Cited

U.S. PATENT DOCUMENTS

| | | | | |
|---|---|---|---|---|
| 950,848 | * | 3/1910 | Gardner | 123/185.14 |
| 3,301,243 | * | 1/1967 | Lyvers | 123/185.14 |
| 3,763,842 | * | 10/1973 | Dooley et al. | 123/185.14 |
| 4,363,298 | * | 12/1982 | Kuhn | 123/185.14 |

* cited by examiner

*Primary Examiner*—Andrew M. Dolinar
(74) *Attorney, Agent, or Firm*—Michael Best & Friedrich, LLP

(57) ABSTRACT

A starting and stopping device for an internal combustion engine includes an energy storing device including at least one elastic member. The elastic member is loaded in response to rotation of a main shaft, and the main shaft rotates in an unloading direction in response to unloading of the elastic member. A locking mechanism selectively prevents the elastic member from unloading from a loaded state by preventing the shaft from rotating in the unloading direction. A clutch mechanism is operatively disposed between the main shaft and the locking mechanism to permit rotation of the shaft in the unloading direction when a preselected torsional threshold between the shaft and the locking mechanism is reached.

19 Claims, 9 Drawing Sheets

| |
|---|
| Fig. 3A |
| Fig. 3B |
| Fig. 3C |

STARTING AND STOPPING DEVICE FOR AN INTERNAL COMBUSTION ENGINE

This application is a continuation-in-part of U.S. application Ser. No. 09/183,425, filed Oct. 30, 1998, now U.S. Pat. No. 6,230,678, the entire contents of which are incorporated herein by reference.

FIELD OF THE INVENTION

The invention relates to starting and stopping devices for internal combustion engines.

BACKGROUND

It is known to provide an engine starting device that utilizes stored energy in a spring to rotate the crankshaft and to start the engine. In these engine starting devices, a mechanism must be provided to wind the spring. For example, U.S. Pat. No. 1,936,554, which is assigned to Briggs and Stratton Corporation (the assignee of the present invention) discloses an electric motor that is positioned adjacent the spring and which may be operated to wind the spring. It is also known to provide a manual crank mechanism interconnected with the spring and operable to wind the spring. Further, it is known to provide a winding mechanism interconnected with the crankshaft that is operable to wind the spring during normal engine running conditions.

SUMMARY

The present invention provides an internal combustion engine having a rotatable engine member, a shaft rotatable in a loading direction in response to rotation of said rotatable engine member, and an energy storing mechanism including at least one elastic member that is selectively coupled to the shaft and loaded by rotation of the shaft in the loading direction. Preferably, the engine further includes a locking mechanism selectively maintaining the elastic member in a loaded state, and a clutch mechanism permitting rotation of the shaft in an unloading direction when a preselected torsional threshold between the shaft and the locking mechanism is reached.

Preferably, the locking mechanism includes a ratchet member, and the clutch mechanism couples the ratchet member to the shaft by friction. The locking mechanism may further include a pawl and a pawl carrier. The pawl selectively prevents rotation of the ratchet member in the unloading direction, and the pawl carrier selectively moves the pawl into and out of engagement with the ratchet member. The engagement between the pawl and the ratchet member creates a line of force that self-energizes the pawl into engagement with the ratchet member when the pawl engages the ratchet member. The pawl carrier is positioned such that the line of force urges the pawl carrier to disengage the pawl from the ratchet member when the pawl engages the ratchet member. A shaft is selectively positioned in a slot in the pawl carrier to substantially prevent undesired disengagement of the pawl from the ratchet member. The pawl carrier is permitted to disengage the pawl from the ratchet member when the shaft is removed from the slot in the pawl carrier.

The engine may further include a gear having a central recessed portion that houses the clutch mechanism. The clutch mechanism may include a clutch plate, clutch washer, and spring washer. A clutch cover is preferably positioned over the recessed portion of the gear to pre-load the clutch mechanism. A brake disk is preferably positioned within the recessed portion of the gear, and the clutch mechanism is preferably sandwiched between the brake disk and the clutch cover to create friction between the brake disk and the gear and between the brake disk and the clutch plate. The ratchet member preferably includes depending ears that engage the clutch plate and couple the ratchet member and clutch plate for rotation together.

A pawl control member may be used to disengage the pawl from the ratchet member during loading of the elastic member. The pawl control member is preferably a friction device that moves the pawl in response to rotation of a rotatable element. The preferred embodiment of the pawl control member is a length of spring wire wrapped around the clutch cover and having a finger extending into a slot in the pawl. The clutch cover rotates with the gear, causing the spring wire to rotate and move the finger within the slot in the pawl. When the finger reaches the end of the slot, the spring wire moves the pawl out of engagement with the ratchet member. When the gear rotates in the unloading direction, the spring wire rotates with the gear due to friction between the spring wire and the clutch cover, permitting the pawl to engage the ratchet member.

BRIEF DESCRIPTION OF THE DRAWINGS

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

Before describing the preferred embodiment, it should be noted that not all of the structural and operational details of the preferred embodiment of this invention may be described in detail. Should additional details of that type be required, reliance is placed on the description and drawings in U.S. application Ser. No. 09/183,425, filed Oct. 30, 1998, now U.S. Pat. No. 6,230,678, the entire contents of which are incorporated herein by reference.

Figure 1:
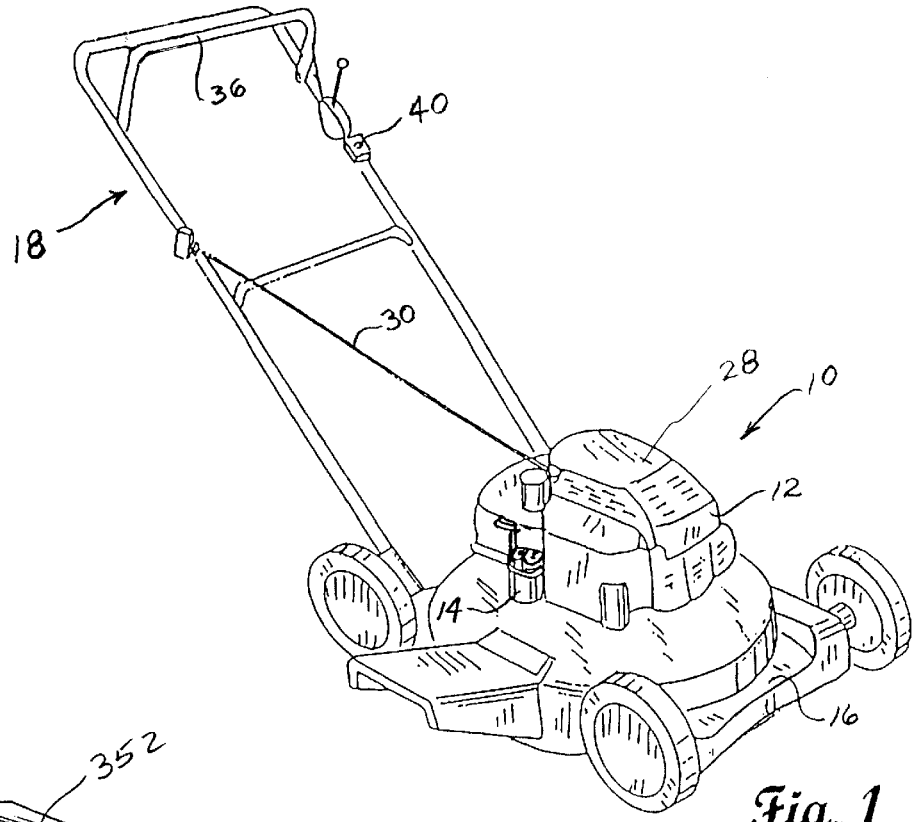
FIG. 1 is a perspective view of a lawnmower incorporating an internal combustion engine and an engine starting device embodying the present invention.
Figure 2:
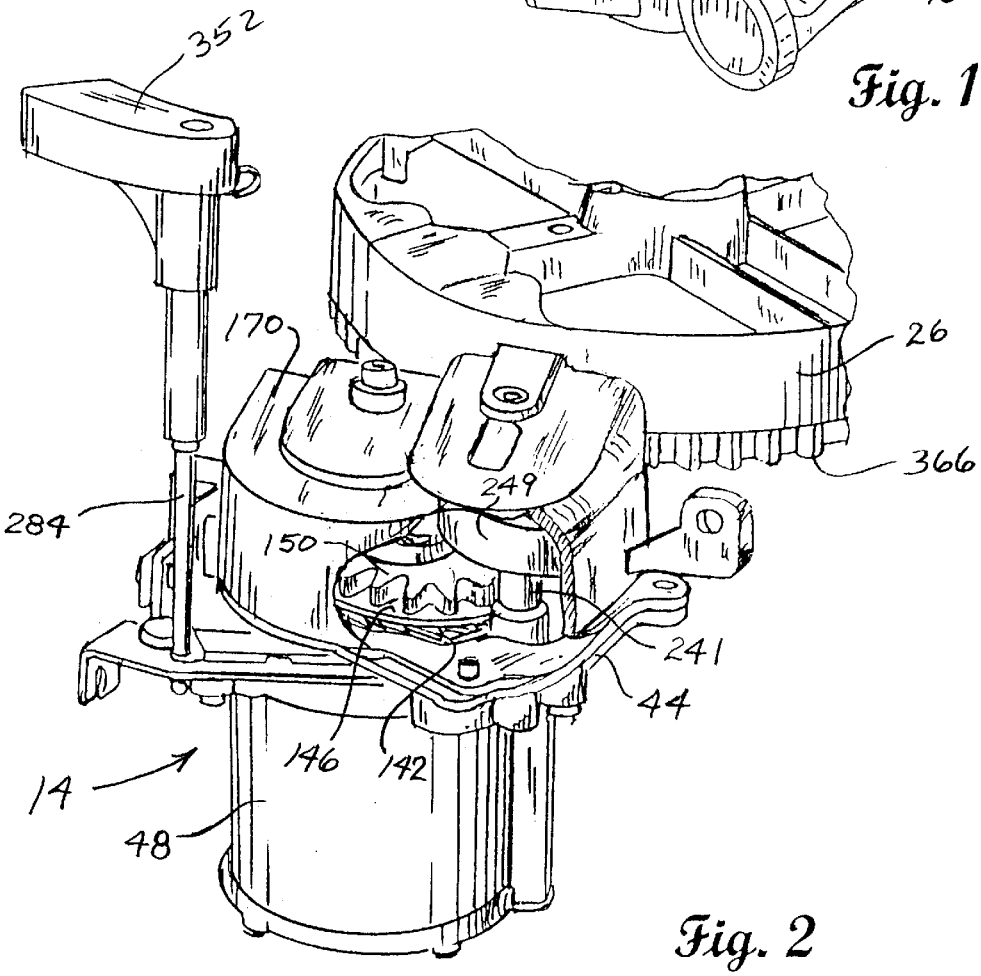
FIG. 2 is a perspective view of the engine starting device.

FIG. 1 illustrates a lawnmower 10 incorporating an internal combustion engine 12 and a device 14 for automatically starting the engine 12. FIG. 2 illustrates the starting device 14 mounted on the engine 12. Portions of the starting device 14 have been cut away in FIG. 2 to illustrate some of the internal components thereof, which components are discussed in detail below. The lawnmower 10 has a deck 16 and a handle assembly 18 extending outwardly and upwardly from the deck 16. The internal combustion engine 12 is mounted on the deck 16. The engine 12 is of the vertical shaft type and includes many components which are of conventional construction. Most of these engine components, however, are substantially enclosed by an engine housing and, thus, not shown in FIG. 1. In addition to the engine starting device 14, the lawnmower 10 is equipped with a recoil starter (not shown) that is mounted above a flywheel 26 (FIG. 2). A shroud 28 is mounted over the recoil starter and a pull cord 30 operatively connected to the recoil starter extends outwardly through the shroud 28.

Although the engine starting device 14 embodying the invention is particularly adapted for use with a lawnmower 10, the engine starting device 14 may also be incorporated with various other manually operable outdoor power equipment and machinery, including, but not limited to, hand held lawn and garden machinery, snow blowers, pumps, pressure washers, and generators. Accordingly, the present invention is not limited to the lawnmower 10 or the engine 12 depicted in the drawings and described herein. For one having ordinary skill in the art, it will become apparent from the drawings and the description how the engine starting device 14 may be adapted for use with various types of machinery and/or various types of engines.

A first manual actuator in the form of an elongated deadman handle or bail handle 36 is interconnected with the handle assembly 18. The bail handle 36 is biased toward the shutdown position shown in FIG. 1. As is known in the prior art, release of the bail handle 36 will initiate shutdown of the engine 12 by disabling ignition to the engine and/or the activation of a brake.

A second manual actuator in the form of a push button 40 is mounted to the handle assembly 18 at a location preferably adjacent one of the pivot pins for the bail handle 36. The push button 40 is operatively interconnected with the bail handle 36. The engine starting device 14 is actuated by depressing the push button 40 and, while the push button 40 is depressed, pivoting the bail handle 36 downward to the starting position. Preferably, the button 40 must be depressed to enable the handle 36 to be pivoted. Thus, the engine starting device 14 may be operated only upon the operator employing two separate motions, i.e., depressing (and holding) the push button 40, and pivoting the bail handle 36 downward.

In alternative embodiments, the bail handle 36 and push button 40 may be replaced by other manual actuators, such as one or more push button devices, lever mechanisms, or other suitable manual actuators. Also, the push button 40 may operate in a different manner than described above. For example, actuation of the push button 40 may actuate or enable a part of the lawnmower startup assembly other than the bail handle 36 to be actuated by the bail handle 36.

Figures 3, 3A:
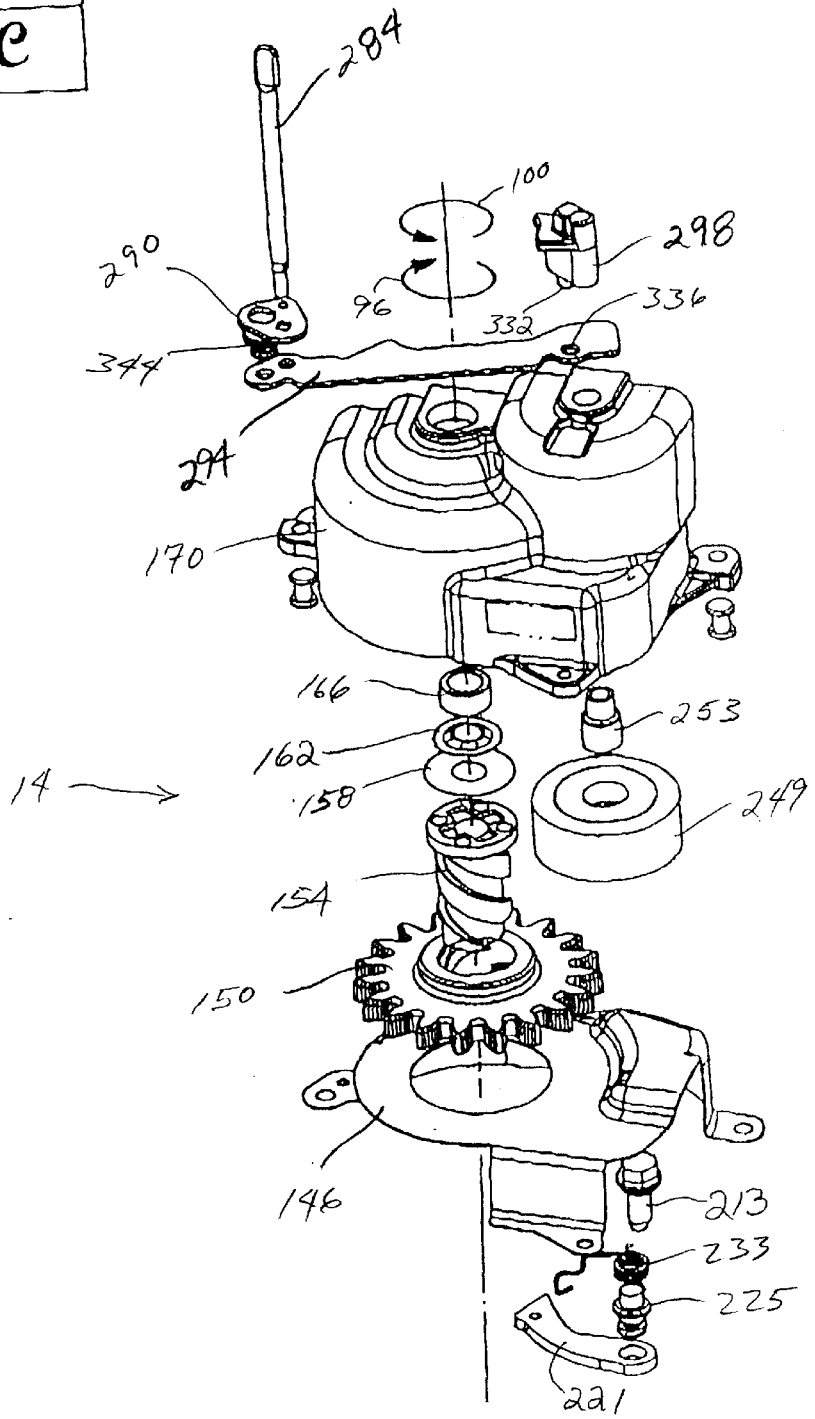
FIG. 3, which includes
FIGS. 3A, 3B, and 3C, is an exploded view of the engine starting device.
Figure 3B:
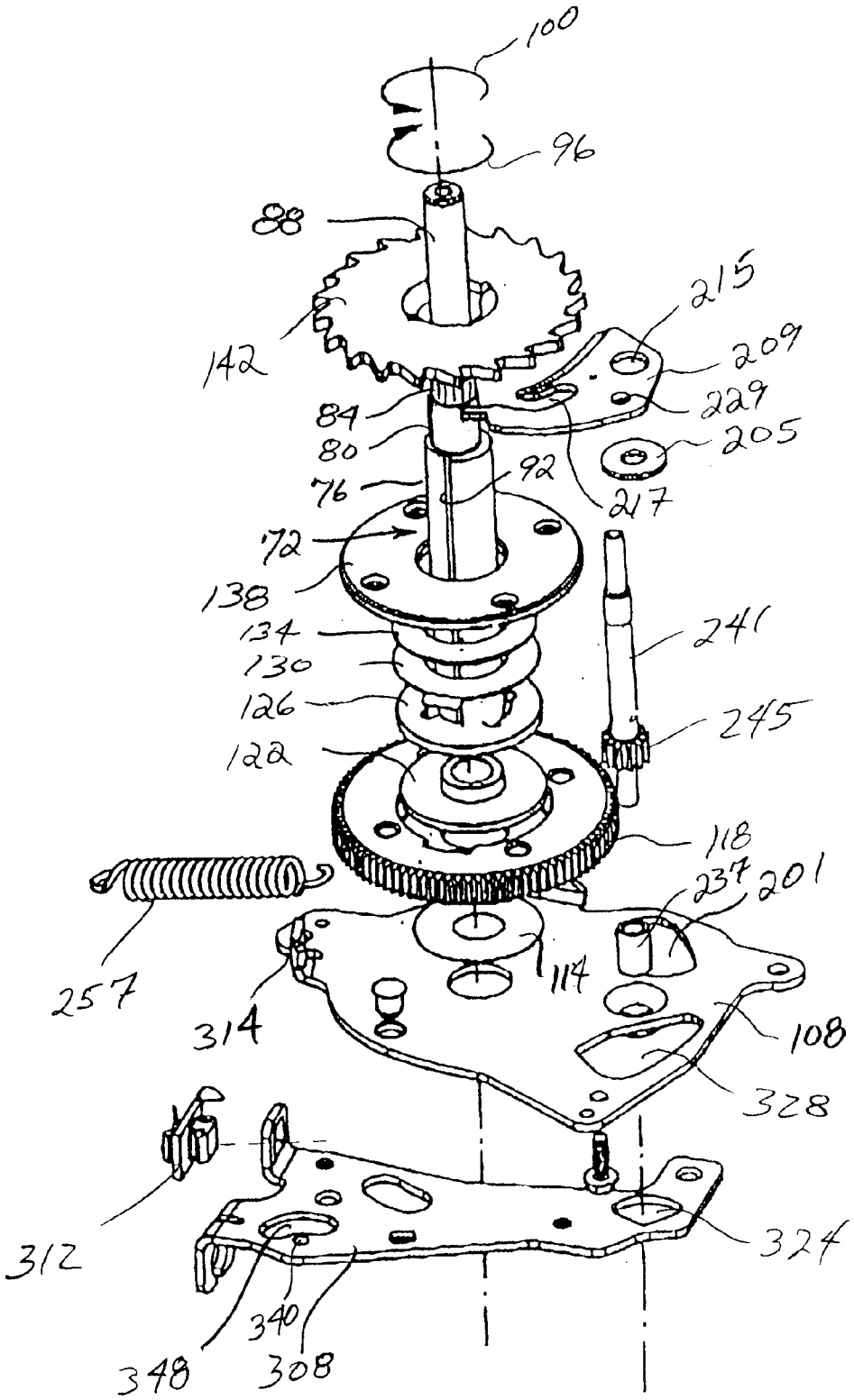
Figure 3C:
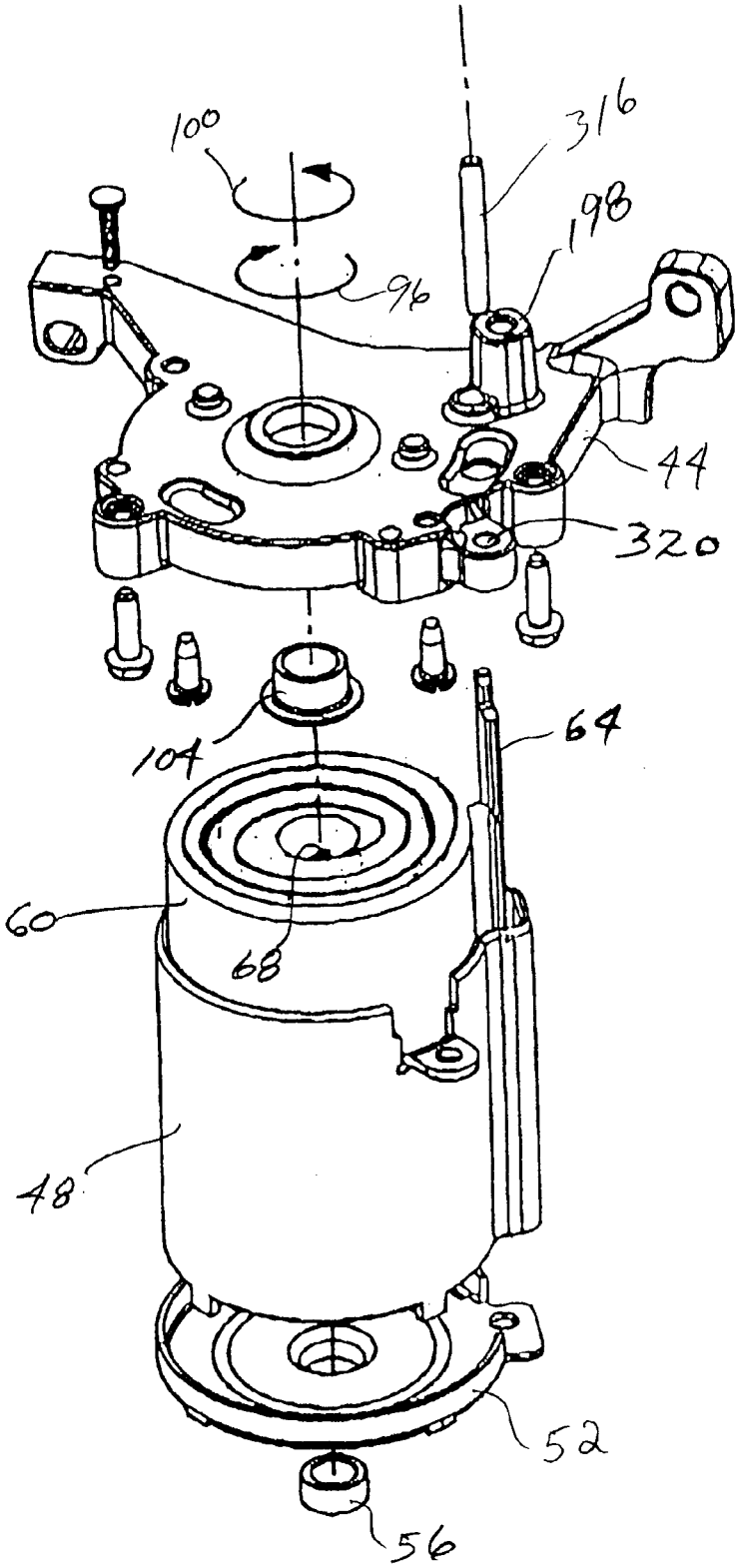

As seen in FIG. 3C, the starting device 14 includes a mounting bracket 44 having a spring housing 48 mounted thereunder. The lower end of the spring housing 48 is closed by an end cap 52, and a lower bearing 56 is fit in the end cap 52. The spring housing 48 houses an elastic member or power spring 60 having an outer end that is coupled to the spring housing 48 with a spring retainer 64, and an inner end that includes a small loop 68.

Referring to FIG. 3B, the starting device 14 also includes a main shaft 72 that has an arbor portion 76 and first, second, and third reduced diameter portions, 80, 84, 88 respectively. The second reduced diameter portion 84 is knurled or splined. The main shaft 72 is supported for rotation at its bottom end by the lower bearing 56. The arbor portion 76 of the main shaft 72 includes an eyelet 92 that releasably receives the loop 68 at the inner end of the power spring 60. The main shaft 72 is rotated in a loading direction 96 to wind and load the power spring 60. As the power spring 60 unloads, it causes rotation of the main shaft 72 in an unloading direction 100 opposite the loading direction 96.

A middle bearing 104 (FIG. 3C) is fit into the mounting bracket 44 and further supports the main shaft 72 for rotation. The middle bearing 104 sits on top of the arbor portion 76 of the main shaft 72, where a shoulder is formed by reducing the diameter of the main shaft 72 to the first reduced diameter portion 80. The shoulder holds the middle bearing 104 above the power spring 60. Alternatively, a snap ring or other structure may be provided on the main shaft 72 to hold the middle bearing 104 away from the top of the power spring 60.

With reference to FIGS. 3A, 3B, and 3C, the first reduced portion 80 of the main shaft 72 extends through the middle bearing 104, the mounting bracket 44, a lower arm 108, a washer 114, and into a main gear 118. The second and third reduced portions 84, 88 extend through a brake disk 122; a clutch assembly including a clutch plate 126, a clutch washer 130, and a spring washer 134 (e.g., a Belleville washer); a clutch cover 138; a ratchet member or wheel 142; a debris cover 146; a pinion gear 150; a starter spline or helix shaft 154; a washer 158; a push nut 162; and an upper bearing 166. The upper bearing 166 is housed in an upper arm or housing 170, and further supports the main shaft 72 for rotation. The debris cover 146 helps deflect debris away from the ratchet member 142 and main gear 118. The upper housing 170 is riveted or otherwise fixed to the debris cover 146 and the lower arm 108. The lower arm 108 (along with the upper housing 170 and the debris cover 146) is pivotable about the main shaft 72 with respect to the mounting bracket 44.

Figure 4:
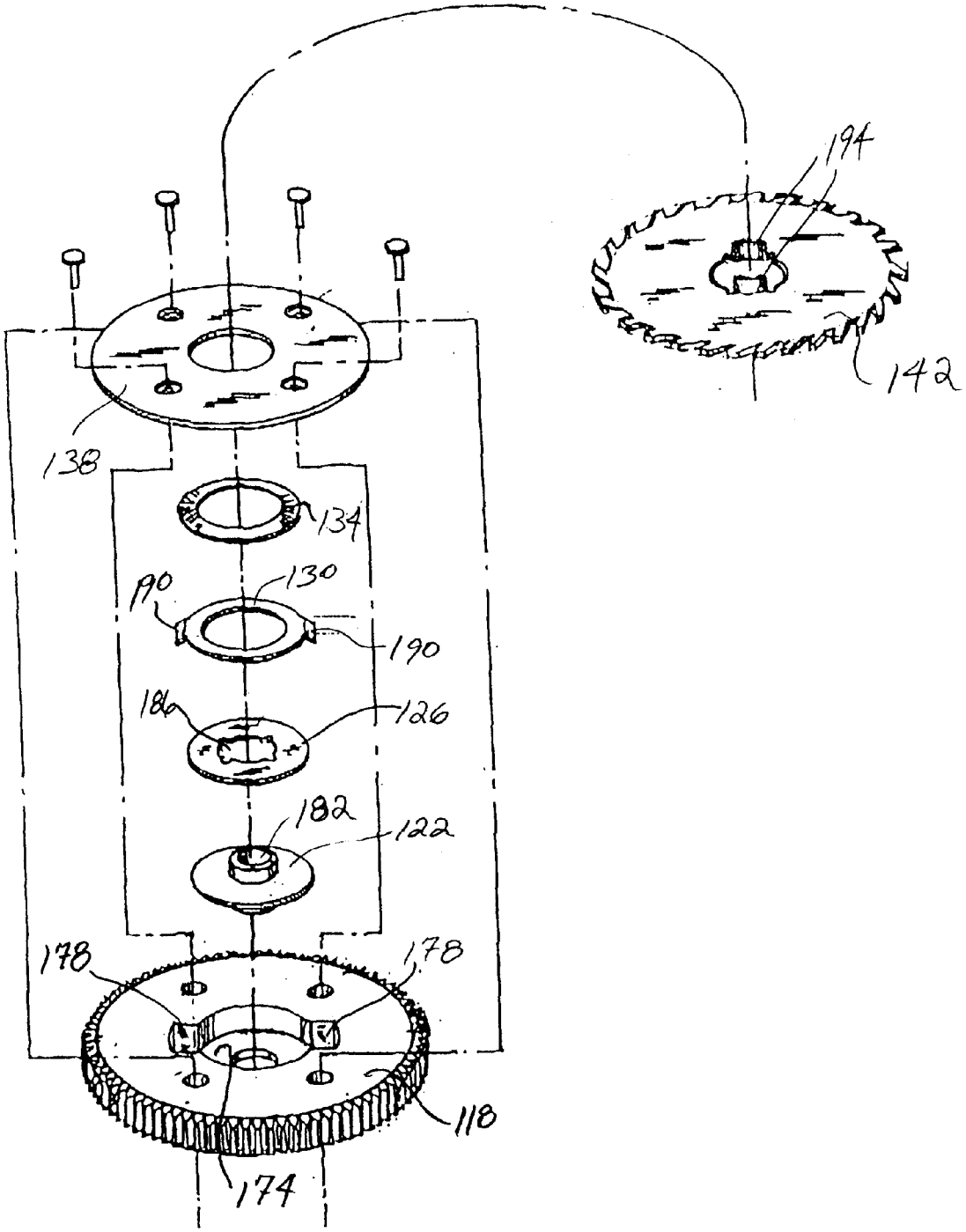
FIG. 4 is an exploded view of a portion of the engine starting device including the clutch assembly.

FIG. 4 better illustrates the main gear 118 and clutch assembly. The main gear 118 includes a central recessed portion 174 having a hole extending therethrough. The recessed portion 174 has a pair of diametrically-opposed cutouts 178. The brake disk 122 includes a central collar portion 182 that is press-fit onto the knurled second reduced diameter portion 84 of the main shaft 72, and therefore may be said to be fixed for rotation with the main shaft 72. The clutch plate 126 includes a non-circular opening 186. The clutch washer 130 includes a pair of ears 190 that are inserted into the cutouts 178 in the main gear 118 to prevent relative rotation between the main gear 118 and the clutch washer 130. The clutch cover 138 is riveted or otherwise permanently affixed to the main gear 118, capturing the clutch assembly and brake disk 122 in the recessed portion 174. The spring washer 134 pre-loads the clutch assembly, and drives the brake disk 122 against the bottom of the recessed portion 174 to cause a frictional interface therebetween. The main gear 118 is thereby frictionally coupled for rotation with the brake disk 122 and main shaft 72.

A frictional interface between the brake disk 122 and the clutch plate 126 is also created by the preloaded spring washer 134. The main shaft 72 and brake disk 122 are thereby frictionally coupled for rotation with the clutch plate 126. The frictional interface between the clutch plate 126 and the brake disk 122 permits torque to be transferred between the clutch plate 126 and the brake disk 122 up to a torsional threshold at which point the clutch plate 126 will slip with respect to the brake disk 122. The ratchet member 142 includes a pair of depending ears 194 that extend through the holes in the clutch cover 138, spring washer 134, and clutch washer 190, and into the non-circular hole 186 of the clutch plate 126. Interference between the non-circular hole 186 and the ratchet member ears 194 causes the ratchet member 142 to be rotationally coupled to the clutch plate 126. This construction therefore couples the main shaft 72 to the ratchet member 142 through the frictional interface between the brake disk 122 and the clutch plate 126.

Referring again to FIGS. 3A, 3B, and 3C, the mounting bracket 44 includes a raised portion 198 having a hole. The raised portion 198 extends through an aperture 201 in the lower arm 108, and supports a washer 205 and a pawl carrier or pawl lever 209. A cap screw 213 (FIG. 3A) or other suitable fastener extends through a hole 215 the pawl carrier 209 and through the washer 205 and is threaded or otherwise secured in the hole in the raised portion 198 to secure the pawl carrier 209 to the raised portion 198. The pawl carrier 209 is free to rotate about the cap screw 213 with respect to the lower arm 108 and mounting bracket 44, and the cap screw 213 provides an axis of rotation for the pawl carrier 209. The pawl carrier 209 includes an open-ended slot 217 and carries a pawl 221 (FIG. 3A). A pawl post 225 extends through the pawl 221 and is mushroomed like a rivet or otherwise secured in a hole 229 in the pawl carrier 209. The pawl post 225 thus provides an axis of rotation for the pawl 221 that is spaced from the axis of rotation of the pawl carrier 209 and that permits the pawl to pivot with respect to the pawl carrier. A torsional spring 233 includes a first end secured to the pawl carrier 209 and a second end secured to the pawl 221 to bias the pawl 221 toward the ratchet member 142.

As seen in FIGS. 3A and 3B, a bearing 237 (FIG. 3B) is inserted into a depression in the lower arm 108, and supports a pinion shaft 241 for rotation. The pinion shaft 241 includes a toothed portion 245 that meshes with the main gear 118. The portion of the pinion shaft 241 above the toothed portion 245 is selectively received in the slot 217 in the pawl carrier 209. The pinion shaft 241 also includes a shoulder or knurl which supports an input member or roller 249 (FIG. 3A). The top of the pinion shaft 241 is supported for rotation in a bearing 253 that is inserted into the upper housing 170. The roller 249 and pinion shaft 241 are fixed (e.g., by a press fit over the knurl or with a key) for rotation together. A return spring 257 (FIG. 3B) extends between the mounting bracket 44 and the lower arm 108, and biases the lower arm 108 to a rest position (FIG. 5) in which the pinion shaft 241 is received within the pawl carrier slot 217. In the rest position, the raised portion 198 abuts the edge of the opening 201 in the lower arm 108 and resists further rotation of the lower arm 108 in that direction. Preferably, the lower arm 108 is interconnected with the bail handle 36 by way of a cable. The lower arm 108 is rotatable to a full-disengaged position (FIG. 6) in response to actuation of the bail handle 36 and push button 40.

Shutdown of the engine will now be discussed. During normal operation, when the bail handle 36 is released, the return spring 257 biases the lower arm 108 to the rest position (FIG. 5), wherein the roller 249 abuts the flywheel 26 (FIG. 2), the pinion shaft 241 enters the pawl carrier slot 217, and the pawl 221 engages the ratchet member 142. The roller 249 is thus rotated by the flywheel 26, which causes the main gear 118 to rotate, which in turn causes the main shaft 72 to rotate and the power spring 60 to be loaded. As the power spring 60 loads, the flywheel 26 is slowed down by the resistance and the engine 12 is stopped. In this regard, the starting device 14 may also be used by itself as a brake or a device to slow the flywheel, and could be used in conjunction with a separate brake. By the time the flywheel 26 has stopped rotating, the power spring 60 is loaded and held in the loaded state by the pawl 221, ready to start the engine 12 the next time it is used.

Alternatively, the power spring 60 may be loaded during engine 12 operation, in which case the starting device 14 would not act as a brake. A mechanism (not shown) may be included to facilitate moving the roller 249 into engagement with the flywheel 26 until the power spring 60 is loaded, and then move the roller 249 out of engagement with the flywheel 26. Alternatively, a loading clutch (not shown) may be used to permit loading of the power spring 60 during engine operation without the need for a mechanism that disengages the roller 249 from the flywheel 26. The loading clutch would permit the power spring 60 to be loaded to a point where the resistance of the power spring 60 to further loading overcomes the torsional threshold of the loading clutch, permitting the roller 249 to continue rolling in response to rotation of the flywheel 26 without overloading the power spring 60.

Regardless of when the power spring 60 is loaded, the pawl 221 permits the ratchet member 142 to rotate in the loading direction 96, but substantially prevents it from rotating in the unloading direction 100. As the ratchet member 142 rotates in the loading direction 96, the pawl 221 rides up the ramp of a first ratchet tooth 261 and falls into the space between the first tooth 261 and a second tooth 265. The torsional spring 233 ensures that the pawl 221 will snap into the space as soon as the pawl 221 clears the first tooth 261. This process continues as the ratchet member 142 rotates with the main shaft 72 and the power spring 60 is loaded. The pawl 221 substantially prevents the ratchet member 142 from rotating in the unloading direction 100 under the influence of the power spring 60. In this regard, the ratchet member 142, the pawl 221, and pawl carrier 209 are collectively referred to herein as a locking mechanism for the power spring 60.

Figure 8:
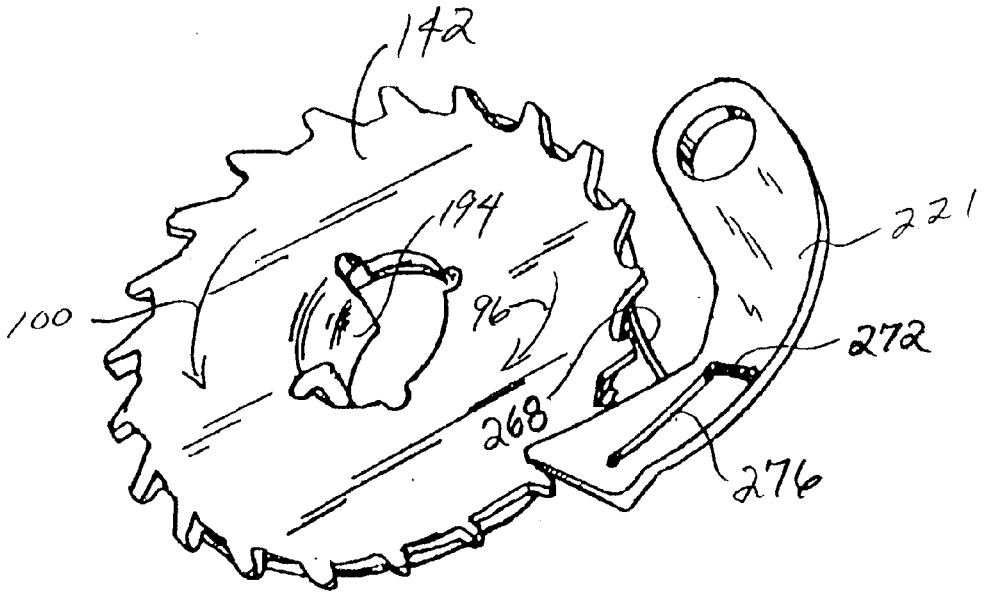
FIG. 8 is a top perspective view of a portion of the engine starting device including the pawl control member.
Figure 9:
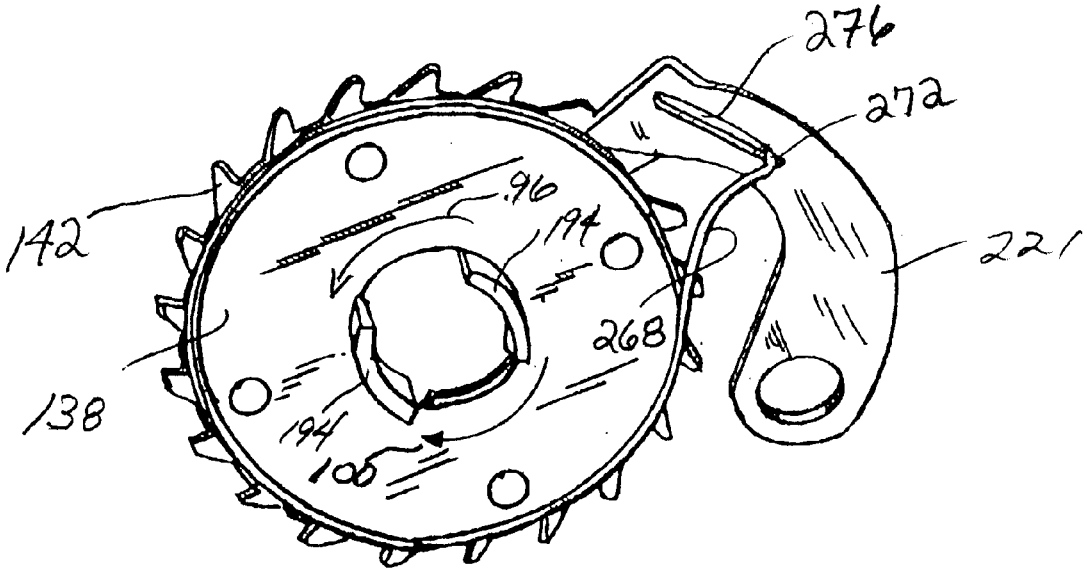
FIG. 9 is a bottom perspective view of a portion of the engine starting device including the pawl control member.

With reference to FIGS. 8 and 9, an optional pawl control member may be used with the starting device 14 to reduce the noise created by the pawl 221 clacking against the ratchet member 142 during loading of the power spring 60. Broadly speaking, the pawl control member may be a frictional member moving in response to rotation of a rotating element. However, the pawl control member is a parasitic load on the system, and therefore should be calibrated to create just enough friction between it and the rotating element to move the pawl 221 out of engagement with the ratchet member 142 (e.g., enough friction to overcome the biasing force of the torsional spring 233). Any additional friction between the pawl control member and the rotating element may further reduce the efficiency of the starting device 14 and should be avoided.

The illustrated pawl control member is a length of spring wire 268 and the illustrated rotating element is the clutch cover 138. The spring wire 268 is wrapped tightly enough around the clutch cover 138 to rotate with the clutch cover 138, and includes a free end bent or shaped as a finger 272. The pawl 221 is provided with a slot 276 into which the finger 272 extends. As the clutch cover 138 rotates in the loading direction 96, the finger 272 moves along the slot 276 in the pawl 221. When the finger 272 reaches the end of the slot 276, it pushes the pawl 221 away from the ratchet member 142. The spring wire 268 holds the pawl 221 in the disengaged position and slips with respect to the clutch cover 138 as the clutch cover 138 continues to rotate in the loading direction 96 (i.e., as the power spring 60 is loaded).

After the flywheel 26 has come to a stop (or if the power spring 60 is loaded during engine operation, when the roller 249 is disengaged from the flywheel 26 or the loading clutch slips), the power spring 60 changes the direction of rotation of the main shaft 72 and the above-described elements that rotate with the main shaft 72 or in response to rotation of the main shaft 72. During this transition, the main shaft 72 and other elements initially rotate relatively slowly in the unloading direction 100 as they gather momentum. This causes the spring wire 268 to rotate slowly in the unloading direction 100. Only a small amount of rotation in the unloading direction 100 is necessary to move the finger 272 backward in the slot 276 and permit the torsional spring 233 to move the pawl 221 into engagement with the ratchet member 142.

Whether the pawl control member is incorporated in the device 14 or not, once the power spring 60 is loaded, the ratchet member 142 is biased by the power spring 60 to rotate in the unloading direction 100. A line of force 280 (FIG. 5) is thereby created due to the interface between the pawl 221 and the ratchet member 142. The line of force 280 extends between the respective axes of rotation of the pawl carrier 209 and the pawl 221 (i.e., the cap screw 213 and pivot post 225 are positioned on opposite sides of the line of force 280). The line of force 280 thus creates a moment force about the pawl axis of rotation that causes the pawl 221 to pivot toward the engaged position shown in FIG. 5. The pawl 221 is thus selfenergized or urged to remain in the engaged position when it is in the engaged position and the power spring 60 is loaded.

Figure 10:
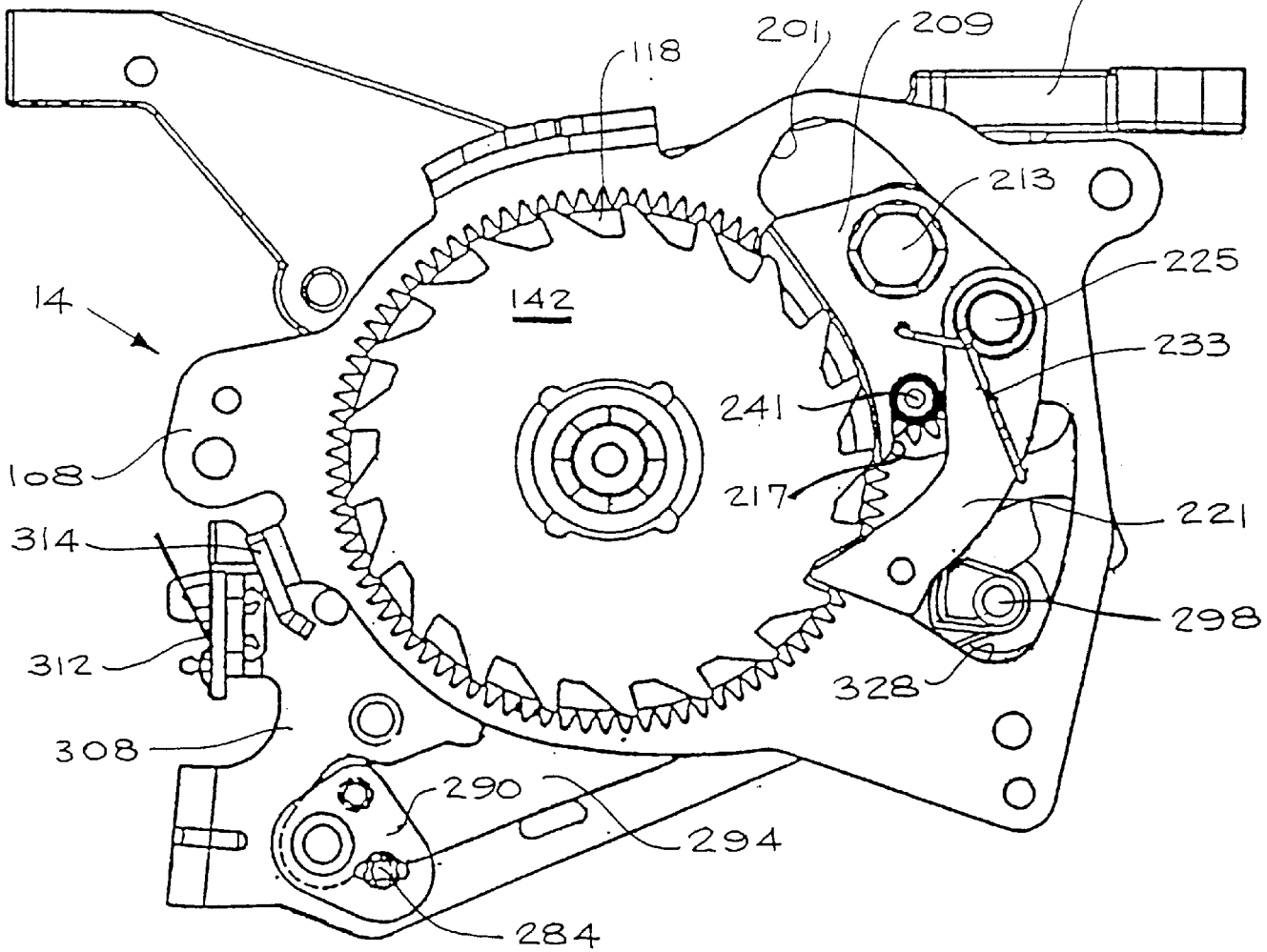
FIG. 10 is a top plan view of the engine starting device with a locking cam engaging the pawl.

As seen in FIGS. 3A and 10, a key shaft 284, key link 290, and lock link 294 are also provided and are interconnected with a lock cam 298. As seen in FIGS. 3B, 5, 6, and 10, a ground bracket 308 supporting a stop switch 312 is also provided. When the bail handle 36 is released, the lower arm 108 pivots to the rest position and a contact tab 314 of the lower arm 108 contacts the stop switch 312, thereby grounding the ignition system to prevent the engine 12 from running. The ground bracket 308 is positioned adjacent the mounting bracket 44. A dowel pin 316 (FIG. 3C) is inserted into a hole 320 in the mounting bracket 44 and extends through an aperture 324 (FIG. 3B) in the ground bracket 308 and an aperture 328 in the lower arm 108. The lock cam 298 is mounted for rotation on the dowel pin 316, and includes a stub shaft 332 that is pivotably received in a hole 336 in the lock link 294. The key shaft 284 extends through the key link 290 and through a hole 340 in the ground bracket 308. The key link 290 is pivotably interconnected with the lock link 294 by way of a depending post 344. The post 344 extends through the lock link 294 and into a curved slot 348 in the ground bracket 308 such that rotation of the key shaft 284 causes the post 344 to follow the curved slot 348 and results in movement of the lock link 294, including some linear actuation of the lock link 294.

Figure 5:
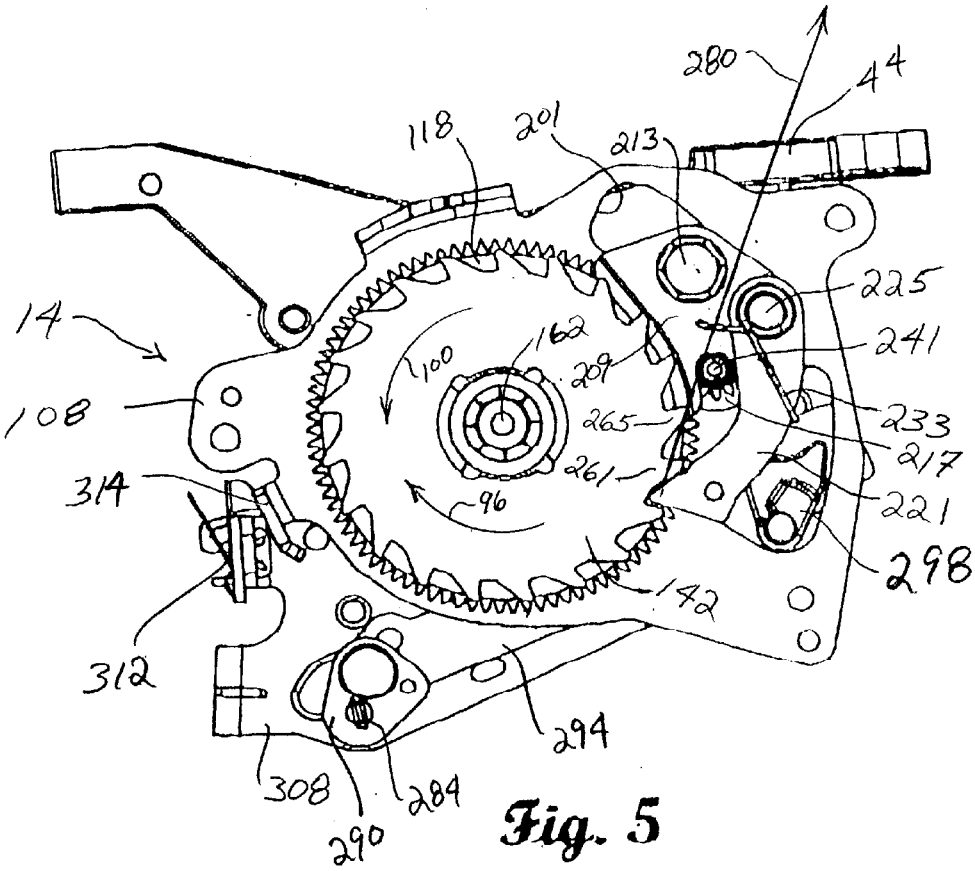
FIG. 5 is a plan view of the engine starting device illustrating the pawl in an engaged position.

In FIG. 5, the lock cam 298 is rotated out of abutment with the pawl 221, permitting the lower arm 108 to be moved out of the rest position. Movement of the lock link 294 causes the lock cam 298 to pivot on the dowel pin 316 into and out of a locked position (FIG. 10). When in the locked position, the lock cam 298 abuts the pawl 221, holding the pawl 221 in engagement with the ratchet member 142 and preventing movement of the lower arm 108 out of the rest position and movement of the pawl carrier 209 away from the ratchet member 142. A removable key 352 (FIG. 2) may be used to rotate the key shaft 284 and move the lock cam 298 into the locked position. In this regard, the removal of the key 352 substantially prevents startup of the engine 12.

Engine startup will now be discussed. Referring again to FIG. 5, the line of force 280 also creates a moment force about the pawl carrier axis of rotation urging the pawl carrier 209 to rotate out of the engaged position when the pawl 221 is in the engaged position. The pawl carrier design substantially reduces the force required to disengage the pawl 221 from the ratchet member 142, and is therefore preferred over actuation of the pawl 221 directly by the pinion shaft. The pinion shaft 241 resists rotation of the pawl carrier 209 when the pinion shaft 241 is positioned in the slot 217. However, when the lower arm 108 is pivoted to move the pinion shaft 241 out of the pawl carrier slot 217, the pawl carrier 209 is urged away from the ratchet member 142 due to the moment force. Additionally, the pinion shaft 241 contacts the pawl carrier 209 and pawl 221 and further causes it to pivot toward the fully-disengaged position shown in FIG. 6. When in the fully-disengaged position, rotation of the pawl carrier 209 is stopped by the end of the pawl carrier 209 abutting the lock cam 298. The lock cam 298 is positioned to stop the pawl carrier's rotation so that the pinion shaft 241 will again enter the pawl carrier slot 217 upon rotation of the lower arm 108 toward the rest position.

Figure 7:
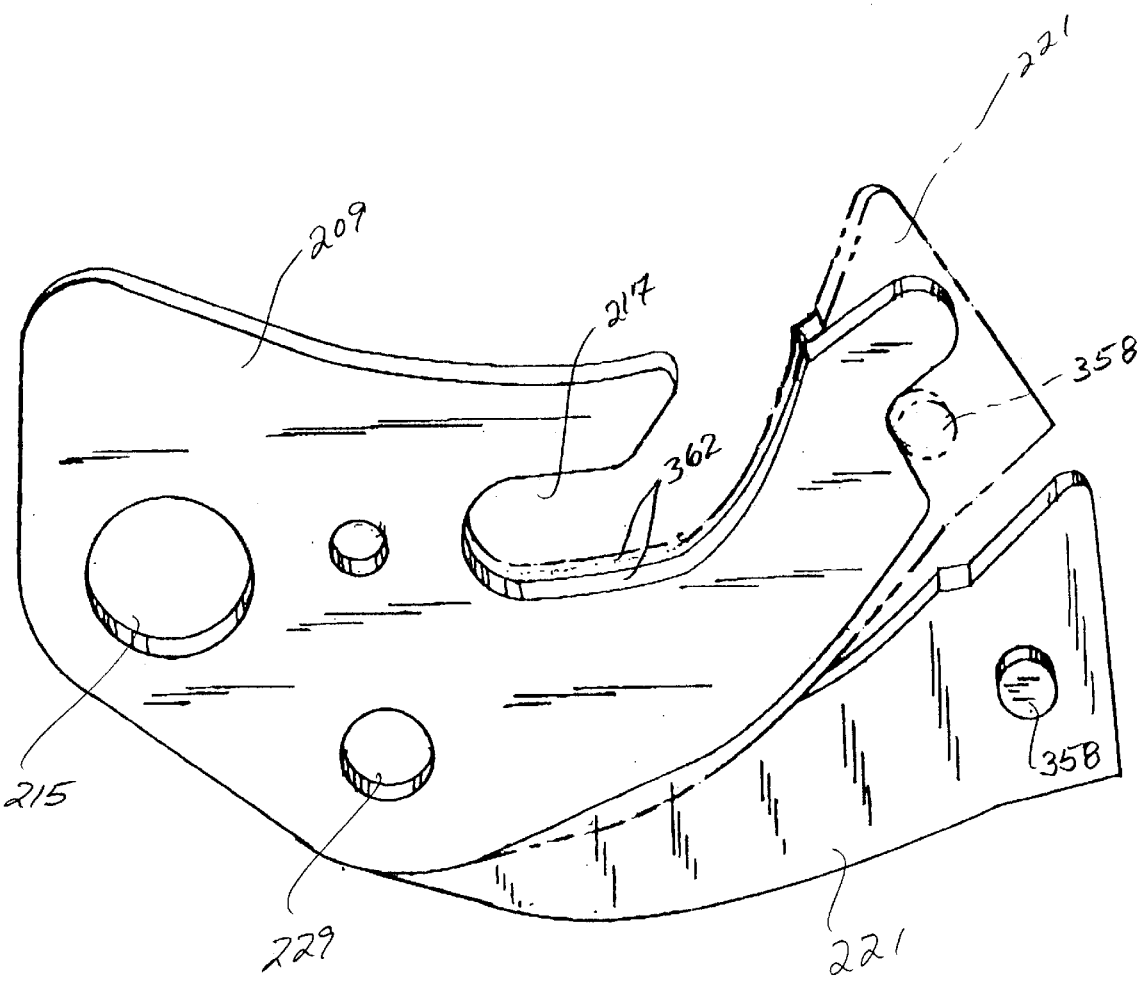
FIG. 7 is a bottom perspective view of a portion of the locking mechanism.

As seen in FIG. 7, the pawl 221 may be provided (e.g., by stamping) with a depending projection 358 that engages a portion of the pawl carrier 209 to prevent the pawl 221 from pivoting over the pawl carrier slot 217. When in the engaged position (shown in phantom), the pawl 221 is held slightly away from the slot 217 or is substantially perfectly aligned with the slot 217 (the substantially perfectly aligned walls indicated with reference numeral 362 in FIG. 7). In this regard, the pinion shaft 241 does not have to move the pawl 221 with respect to the pawl carrier 209 as the pinion shaft 241 is moved out of the slot 217, thereby decoupling the torsional spring 233 substantially entirely from movement of the pawl carrier 209 (i.e., the torsional spring has substantially no effect on movement of the pawl carrier 209).

Figure 6:
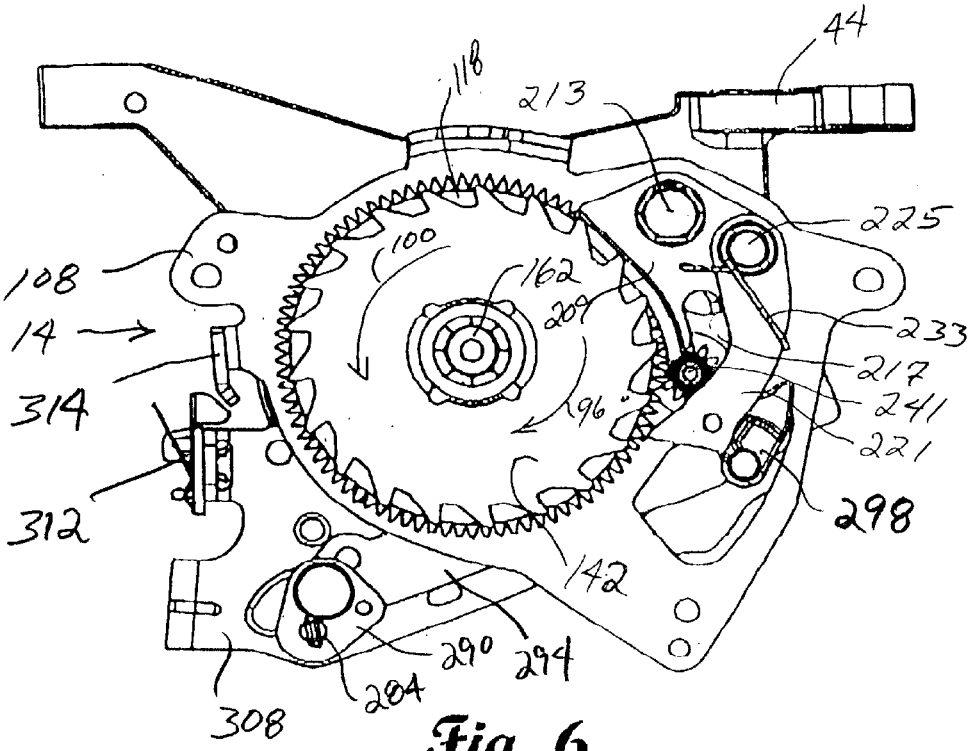
FIG. 6 is a plan view of the engine starting device illustrating the pawl in a disengaged position.

With the lock cam 298 rotated to the unlocked position shown in FIGS. 5 and 6, the bail handle 36 may be actuated (in combination with actuation of the push button 40), causing the lower arm 108 to pivot to the position shown in FIG. 6, which causes the pawl 221 to move out of engagement with the ratchet member 142, which then permits the power spring 60 to unload. As the power spring 60 unloads, the main shaft 72 is rotated in the unloading direction 100. The bottom end of the helix shaft 154 engages the ears 194 of the ratchet member 142, causing the helix shaft 154 to be rotated with the main shaft 72. The speed of rotation of the helix shaft 154 causes the pinion gear 150 to climb up the helix shaft 154. When at the top of the helix shaft 154, the pinion gear teeth engage the teeth of a flywheel gear 366 (FIG. 2), causing the flywheel 26 to rotate and start the engine 12. As the engine ramps up in speed and the power spring 60 unloads, the flywheel 26 soon rotates faster than the main shaft 72 and helix shaft 154 (i.e., the flywheel overruns the pinion gear 154) and causes the pinion gear 154 to rotate back down the helix shaft 154.

As the power spring 60 approaches or achieves a fully unloaded state, the loop 68 at the inner end of the power spring 60 is extracted from the eyelet 92 of the arbor portion 76 of the main shaft 72, decoupling the main shaft 72 from the power spring 60. Such decoupling reduces wear and fatigue on the power spring 60, increases the life of the power spring 60, and substantially prevents snapping off the inner end of the power spring 60.

Should the operator release the bail handle 36 as the power spring 60 is unloading, the return spring 257 will cause the lower arm 108 to move the pawl 221 into engagement with the ratchet member 142. The dynamic force transferred to the pawl 221 under these circumstances may be very high due to the angular momentum of the rotating main shaft and other elements. To reduce damage to the pawl 221, the torsional threshold of the clutch mechanism is set to permit relative rotation between the main shaft 72 and the ratchet member 142 under these circumstances. More specifically, the clutch plate 126 will slip on the brake disk 122 when the torsional threshold is reached. In such an occurrence, the power spring 60 may substantially entirely unload without being reloaded, and may require that the engine 12 be manually started with the recoil starter on the next startup.

What is claimed is:

1. An internal combustion engine comprising:

a rotatable engine member;

a shaft rotatable in a loading direction in response to rotation of said rotatable engine member, said shaft rotatable in an unloading direction opposite said loading direction to start said engine;

an energy storing mechanism including at least one elastic member, said elastic member being loaded in response to rotation of said shaft in said loading direction and causing said shaft to rotate in said unloading direction in response to unloading of said elastic member;

a locking mechanism selectively preventing rotation of said shaft in said unloading direction to maintain said elastic member in a loaded state; and a clutch mechanism operatively disposed between said locking mechanism and said shaft to permit rotation of said shaft in said unloading direction when a preselected torsional threshold between said shaft and said locking mechanism is reached.

2. The engine of claim 1, wherein said locking mechanism includes a ratchet member and a pawl selectively engageable with said ratchet member, said clutch mechanism coupling said ratchet member to said shaft for rotation therewith while the torsional force between said ratchet member and shaft is below said torsional threshold.

3. The engine of claim 1, further comprising:

a gear having a central recessed portion and a gear hole in said recessed portion; and a clutch cover affixed to said gear and at least partially covering said recessed portion and capturing said clutch mechanism within said recessed portion, said clutch cover having a hole in alignment with said gear hole, said shaft extending through said holes in said gear and said clutch cover.

4. The engine of claim 3, further comprising:

a brake disk attached to said shaft and disposed in said recessed portion of said gear;

wherein said clutch mechanism includes a clutch plate, clutch washer, and spring washer captured between said clutch cover and said brake disk, said spring washer being compressed by said clutch cover to cause a frictional coupling between said brake disk and said gear and to cause a frictional coupling between said clutch plate and said brake disk; and wherein said locking mechanism includes a ratchet member having a hole through which said shaft extends and a pawl selectively engageable with said ratchet member, said ratchet member including a portion extending into said recessed portion and engaging said clutch plate to fix said ratchet member for rotation with said clutch plate.

5. The engine of claim 1, wherein said torsional threshold is set to allow relative movement between said locking mechanism and said shaft in the event of an attempt to stop rotation of said shaft in said unloading direction during unloading of said elastic member.

6. The engine of claim 1, wherein said torsional threshold is set to reduce damage to said locking mechanism.

7. An internal combustion engine comprising:

a rotatable engine member;

an energy storing mechanism including at least one elastic member, said elastic member being loaded in response to rotation of said rotatable engine member;

a ratchet member operatively disposed between said elastic member and said rotatable engine member, said ratchet member rotating in a loading direction in response to rotation of said rotatable engine member and said elastic member being loaded in response to rotation of said rotatable engine member;

a pawl movable into engagement with said ratchet member to selectively prevent rotation of said ratchet member in an unloading direction opposite said loading direction and to thereby selectively prevent unloading of said elastic member, said engagement between said ratchet member and said pawl establishing a line of force, said pawl positioned with respect to said line of force such that said pawl is urged toward staying in engagement with said ratchet member when in engagement with said ratchet member; and a pawl carrier carrying said pawl and movable to remove said pawl from engagement with said ratchet member, said pawl carrier being positioned with respect to said line of force such that said pawl carrier is urged to disengage said pawl from said ratchet member when said pawl is in engagement with said ratchet member.

8. The engine of claim 7, wherein said pawl is pivotable about a first axis of rotation and said pawl carrier is pivotable about a second axis of rotation, said first and second axes of rotation being positioned on opposite sides of said line of force.

9. The engine of claim 7, wherein said pawl is pivotable about an axis of rotation, said engine further comprising a biasing member biasing said pawl toward engagement with said ratchet member.

10. The engine of claim 7, wherein said pawl carrier includes a slot, said engine further comprising a shaft received in said slot to prevent said pawl carrier from moving said pawl out of engagement with said ratchet member, one of said pawl carrier and shaft being movable to remove said shaft from said slot and permit said pawl carrier to move said pawl from engagement with said ratchet member.

11. The engine of claim 10, wherein said shaft is a pinion shaft, said engine further comprising an input element supported by said pinion shaft and selectively engageable with said rotating engine member to cause rotation of said ratchet member in said loading direction and loading of said elastic member.

12. The engine of claim 10, further comprising an arm supporting said shaft and movable to cause said shaft to move out of said slot in said pawl carrier.

13. The engine of claim 12, wherein said arm is biased to move said shaft into said slot.

14. The engine of claim 7, further comprising a pawl control member moving one of said pawl and said pawl carrier to position said pawl out of engagement with said ratchet member in response to said ratchet member rotating in said loading direction.

15. The engine of claim 14, further comprising a rotating element located near said ratchet member and rotatable in response to rotation of said rotatable engine member, wherein said pawl control member includes a length of spring wire at least partially wrapped around said rotating element, said spring wire engaging said pawl such that when said rotating element rotates in said loading direction, said spring wire moves said pawl out of engagement with said ratchet member, and wherein said spring wire permits said pawl to engage said ratchet member in response to said rotating element rotating in said unloading direction.

16. The engine of claim 15, wherein said pawl includes a slot, and wherein said spring wire includes a finger extending into said slot.

17. An internal combustion engine comprising:

a rotatable engine member;

an energy storing mechanism including at least one elastic member, said elastic member being loaded in response to rotation of said rotatable engine member;

a ratchet member operatively disposed between said elastic member and said rotatable engine member, said ratchet member rotating in a loading direction in response to rotation of said rotatable engine member, said ratchet member rotating in an unloading direction opposite said loading direction in response to unloading of said elastic member;

a pawl selectively movable into engagement with said ratchet member to selectively prevent said ratchet member from rotating in said unloading direction; and a pawl control member moving said pawl out of engagement with said ratchet member while said ratchet member rotates in said loading direction and moving said pawl toward engagement with said pawl in response to said ratchet member rotating in said unloading direction.

18. The internal combustion engine of claim 17, wherein said pawl includes a slot, and wherein said pawl control member includes a length of spring wire including a finger received in said slot.

19. The engine of claim 17, further comprising a rotating element located near said ratchet member and rotatable in response to rotation of said rotatable engine member, wherein said pawl control member includes a length of spring wire at least partially wrapped around said rotating element, said spring wire engaging said pawl such that when said rotating element rotates in said loading direction, said spring wire moves said pawl out of engagement with said ratchet member, and wherein said spring wire permits said pawl to engage said ratchet member in response to said rotating element rotating in said unloading direction.

* * * * *